US006016818A

United States Patent [19]

Evaro et al.

[11] Patent Number: 6,016,818

[45] **Date of Patent: *Jan. 25, 2000**

[54] RECIRCULATING PARTS WASHER

[75] Inventors: Jose E. Evaro, Irving; Dale V. Kiplinger, Carrollton; David L. Varnell, Mabank; Don A. York, Grandview, all of Tex.

[73] Assignee: NCH Corporation, Irving, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/863,702

[22] Filed: May 27, 1997

Related U.S. Application Data

[60] Provisional application No. 60/022,554, Jul. 18, 1996.

[51] Int. Cl.[7] ..... B08B 3/02

[52] U.S. Cl. ..... 134/56 R; 134/111; 134/113; 134/201; 4/644; 4/628

[58] Field of Search ..... 134/58 R, 56 R, 134/57 R, 113, 111, 110, 166 R, 169 R, 167 R, 168 R, 169 C, 120, 121, 201; 4/644, 516, 518, 625, 627, 638, 640

[56] References Cited

U.S. PATENT DOCUMENTS

| | | | |
|---|---|---|---|
| 261,991 | 8/1882 | Bond . | |
| 1,305,624 | 6/1919 | Schneider et al. . | |
| 2,646,585 | 7/1953 | Whittington | 134/111 |
| 3,013,280 | 12/1961 | Coffman et al. . | |
| 3,068,491 | 12/1962 | Perekrestenko . | |
| 3,522,814 | 8/1970 | Olson | 134/111 |
| 3,594,830 | 7/1971 | Clifton . | |
| 3,614,791 | 10/1971 | Newburger . | |
| 3,971,394 | 7/1976 | Osborne | 134/111 |
| 4,052,227 | 10/1977 | Delo et al. | 134/113 |
| 4,056,114 | 11/1977 | Boutillette | 134/111 |
| 4,072,157 | 2/1978 | Wines, Jr. et al. . | |
| 4,105,342 | 8/1978 | Plourde | 134/111 |
| 4,328,597 | 5/1982 | Bodin . | |
| 4,505,284 | 3/1985 | Kyatt | 134/111 |
| 4,791,947 | 12/1988 | Holzberger . | |
| 4,817,649 | 4/1989 | Schmalz, Jr. et al. | 134/111 |
| 5,303,725 | 4/1994 | Hilgren | 134/111 |
| 5,305,481 | 4/1994 | Nebb . | |
| 5,313,676 | 5/1994 | Wright . | |
| 5,368,653 | 11/1994 | Russell | 134/111 |
| 5,513,667 | 5/1996 | Usher . | |
| 5,598,861 | 2/1997 | Danowski et al. | 134/111 |
| 5,760,668 | 6/1998 | Testa et al. . | |

FOREIGN PATENT DOCUMENTS

| | | |
|---|---|---|
| 2203813 | 3/1988 | United Kingdom . |

*Primary Examiner*—Frankie L. Stinson
*Attorney, Agent, or Firm*—Locke Liddell & Sapp LLP; Monty L. Ross

[57] ABSTRACT

A recirculating parts washer is disclosed that features a vertically mounted base and a sink and lid rotatably connected to the base. The recirculating parts washer features a cleaning fluid supply container which is separate from the sink but connected to it via a supply line and a drain line.

Cleaning fluid is circulated to the sink via the supply line by means of a submersible pump submerged within the cleaning fluid inside the cleaning fluid supply container. Cleaning fluid returns to the supply container via the drain line, thus enabling the cleaning fluid to be reused over and over again until it is exhausted.

By having the sink and lid rotatably mounted to the base of the recirculating parts washer, the bulk of the assembly can be conveniently pivoted upwards and back against the wall when not in use. The recirculating parts washer also features a direct current power supply assembly.

26 Claims, 3 Drawing Sheets

RECIRCULATING PARTS WASHER

CROSS-REFERENCE TO RELATED APPLICATIONS

The present application claims priority based on Provisional Application No. 60/022,554, filed Jul. 18, 1996.

BACKGROUND OF THE INVENTION

1. Field of the Invention

This invention relates to the equipment used to wash small machine parts by hand using cleaning solutions. More particularly, this invention relates to a novel recirculating parts washer for accomplishing this purpose.

2. Description of Related Art

Wherever machines are made, used or repaired, the need to clean small parts is present. Although, in some circumstances, the need is readily met, in others it is met only with difficulty and at a substantial cost.

For example, many machine shops around the world labor under the burden of extremely small work environments. In these constricted work areas, space is at a premium. Large parts washing areas, while convenient, are inefficient in that they impede the ability of workers to utilize the space around them for other equally important tasks.

Furthermore, under such conditions, safety issues become increasingly important. When numerous kinds of machinery are operated in close proximity, the dangers associated with having open containers of potentially volatile chemicals increase.

Smaller sinks and increased policing of chemical handling practices do not really solve the problem. They simply make the washing of parts less efficient in the interest of safety.

What is needed is a parts washing facility that is spacious when in use and compact when idle. Preferably, such a station would facilitate the handling of the cleaning fluid, both from the standpoint of cleaning the parts and from the standpoint of replacing the cleaning fluid when it has exhausted its useful life. Furthermore, it would be extremely desirable for the facility to promote (rather than undermine) safe and environmentally sound workplace practices.

Finally, the parts washing station's utility would be greatly increased if it featured some measure of portability, so that work vehicles would have the same access to an efficient parts washing facility that the main office does.

SUMMARY OF THE INVENTION

A recirculating parts washer is disclosed that features a vertically mounted base and a sink and lid rotatably connected (i.e., hinged) to the base. Importantly, the recirculating parts washer features a cleaning fluid supply container which is separate from the sink but connected to it via a supply line and a drain line.

Cleaning fluid is circulated to the sink by means of a submersible pump submerged within the cleaning fluid inside the cleaning fluid supply container. This arrangement permits the user to utilize the actual container in which the cleaning fluid was delivered as the supply container, instead of transferring the cleaning fluid from one container to another. The cleaning fluid is recirculated to the supply container via the drain line, thus enabling the cleaning fluid to be reused until it is no longer serviceable.

By having the sink and lid rotatably mounted to the base of the recirculating parts washer, the bulk of the assembly can be conveniently pivoted upwards and back against the wall when not in use. Furthermore, in this configuration, workplace exposure to potentially volatile fumes is minimized.

The recirculating parts washer is equipped with a fusible link which facilitates rapid closure of the lid in the event a volatile cleaning fluid should unexpectedly catch fire. It also features a power supply assembly that facilitates use with either an AC-to-DC converter or a battery.

DETAILED DESCRIPTION

Figure 1:
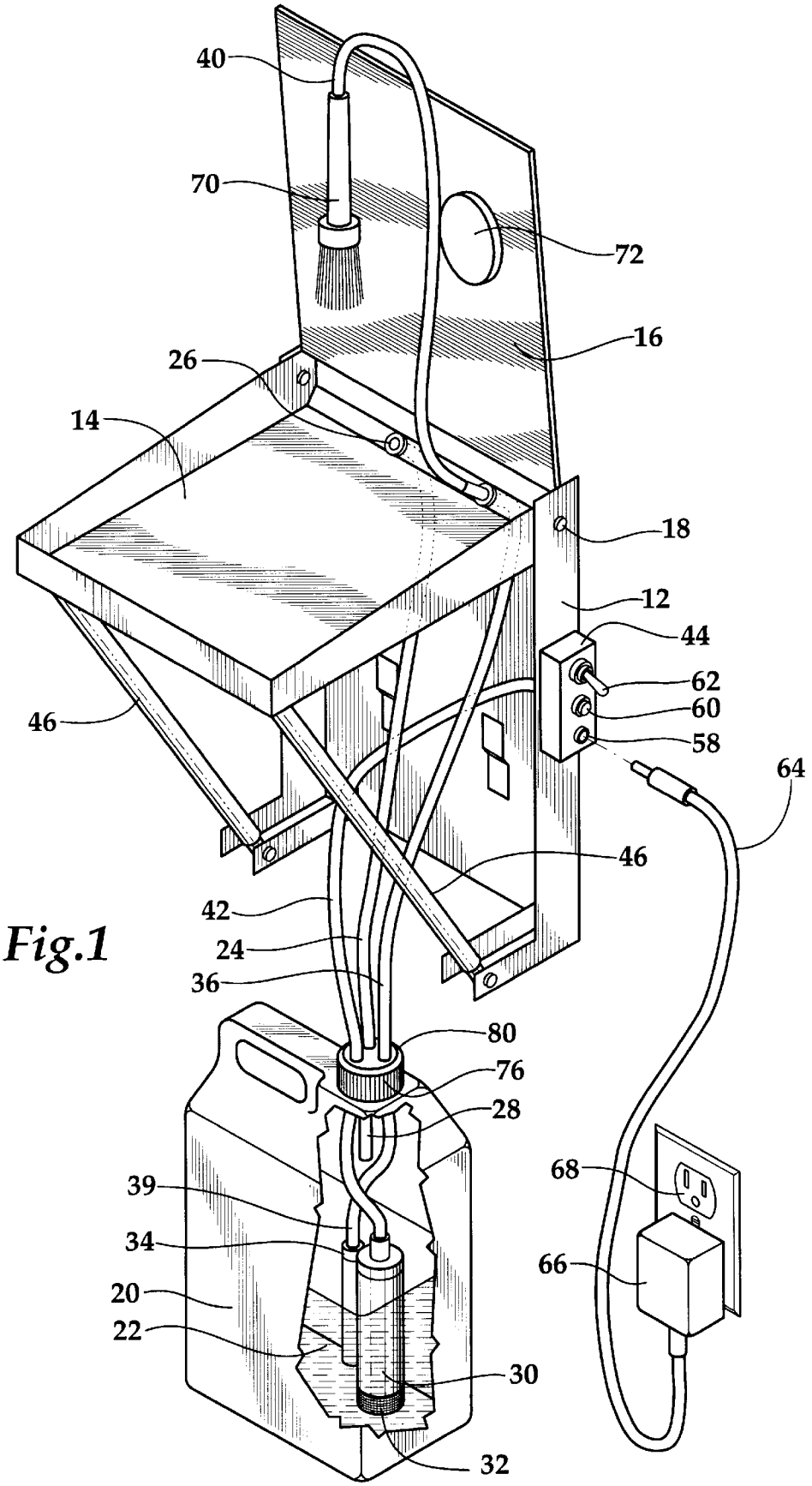
FIG. 1 is an isometric view of the invention, a recirculating parts washer.

Referring to FIG. 1, a recirculating parts washer 10 is shown. The recirculating parts washer 10 comprises a base 12; a sink 14 rotatably connected to the base; and a lid 16 rotatably connected to the base as well. In the particular embodiment shown in FIG. 1, both the sink 14 and the lid 16 are hinged about pins 18 to the base 12. As is apparent from the general purview of FIG. 1, the base 12 may be mounted to any convenient flat, stable, and vertical surface.

The recirculating parts washer 10 also comprises a separate cleaning fluid reservoir 20 containing a cleaning fluid 22. The separate cleaning fluid reservoir 20 communicates with the sink 14 by means of a drain line 24. This drain line 24 has a drain line inlet end 26 communicating with the sink 14 and a drain line exit end 28 communicating with the separate cleaning fluid reservoir 20.

The recirculating parts washer 10 further comprises a submersible pump 30 submerged in the cleaning fluid 22. The submersible pump 30 has a suction opening 32 communicating with the cleaning fluid 22 and a discharge opening 34 communicating with the sink 14 by means of a supply line 36. The supply line 36 is a length of tubing defined by its supply line inlet end 38 (which communicates with the discharge opening 34 of the submersible pump 30) and its supply line exit end 40 (which communicates with either the sink 14 or a washing brush 70 as shown in FIG. 1). The submersible pump 30 also comprises a power cable 42 transferring power from a power supply assembly 44, which is attached to the base 12, to the submersible pump 30.

In practice, centrifugal submersible pumps have been found to be useful, although other types of pumps would likely be effective as well. Supply and drain lines featuring a ⅜" diameter have been found to provide a sufficient flow rate for cleaning and recirculation.

It will be appreciated at this point that important advantages stem from the use of the separate cleaning fluid reservoir 20 and the submersible pump 30. One advantage stems from the fact that the separate cleaning fluid reservoir

20 is preferably the container in which the cleaning fluid 22 is shipped to the user. one-gallon containers of cleaning fluid have been found to have a neck large enough to accommodate a properly sized submersible pump 30. Whenever cleaning fluid 22 is too dirty to be of further effective use, the submersible pump 30 is simply removed from the current separate cleaning fluid reservoir 20 and placed inside a new one. This allows for an almost "hands off" replacement of cleaning fluid 22, frequently a desirable safety feature.

The recirculating parts washer 10 preferably comprises at least one adjustable support arm 46 attached to the base 12. A comparison of FIGS. 1, 2, and 3 reveals that the adjustable support arm 46 is preferably adapted to hold the sink 14 in at least two temporarily fixed positions. This is effected in the embodiment shown in FIGS. 1–4 by means of an adjustable support arm 46 that comprises telescoping concentric tubes, although concentric members of any convenient cross-sectional shape (e.g., square, rectangular) would also likely be effective.

Figure 2:
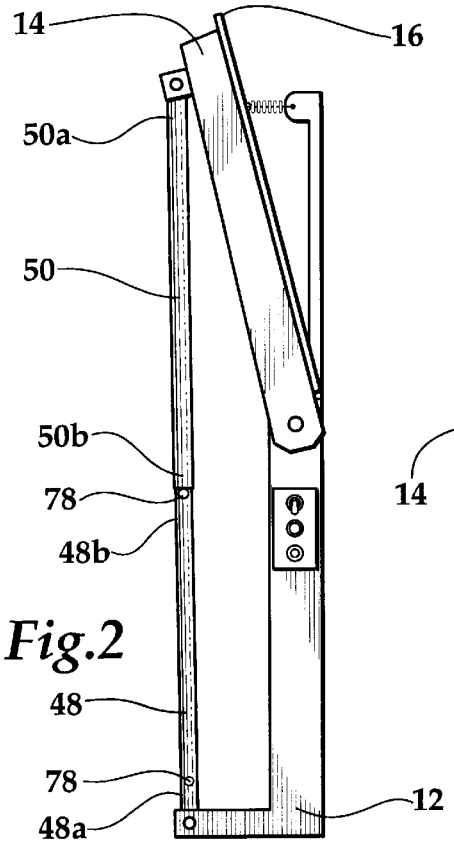
FIG. 2 is a side view of the invention, depicting the invention in a "stored" configuration (i.e., a configuration which would be typical of the invention when it is not in use).

Referring now to FIG. 2, adjustable support arm 46 comprises two telescoping concentric tubes, inner concentric tube 48 and outer concentric tube 50. Each concentric tube has an engaged (i.e., telescopically engaging) end and a free end. As depicted in FIG. 2, the free ends are outer free end 50*a* (connected to the sink 14) and inner free end 48*a* (connected to the base 12). The engaged ends are outer engaged end 50*b* and inner engaged end 48*b*.

As depicted in FIG. 2, when the recirculating parts washer 10 is not in use, the sink 14 may be elevated to the maximum extent allowed by the apparatus, dramatically reducing the space the invention occupies in the places where it is used. Furthermore, in this configuration, exposure of workers and the workplace to potentially volatile cleaning fluids 22 and their fumes is minimized. Note how, in this position, the lid 16 is tightly and safely sealed against the sink 14. The use of the adjustable support arms 46 makes this possible. In particular, the telescoping concentric tubes 48 and 50 of the adjustable support arms 46 extend so that the distance between the free ends 48*a* and 50*a* is extended as far as the apparatus will allow. Note that locking means 78 (in FIG. 2, a spring-activated catch or button) releasably holds the sink 14 in one of at least two positions. In FIGS. 1, 3, 4, and 5 the locking means holds the sink 14 in a substantially horizontal position ready for use. In FIG. 2, the locking means 78 holds the sink 14 in an elevated position for short- or long-term storage.

Figure 3:
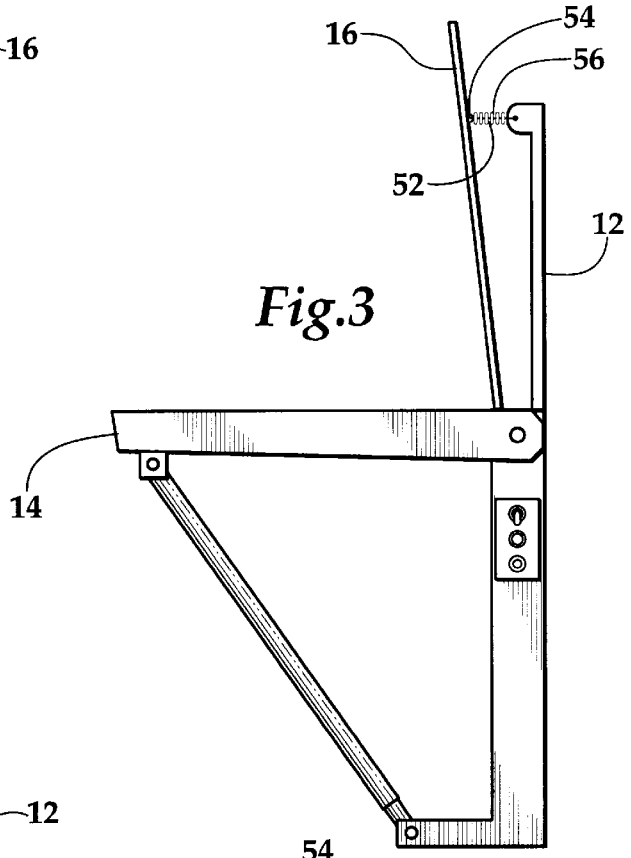
FIG. 3 is a side view of the invention, depicting the invention in an "actual use" configuration.
Figure 4:
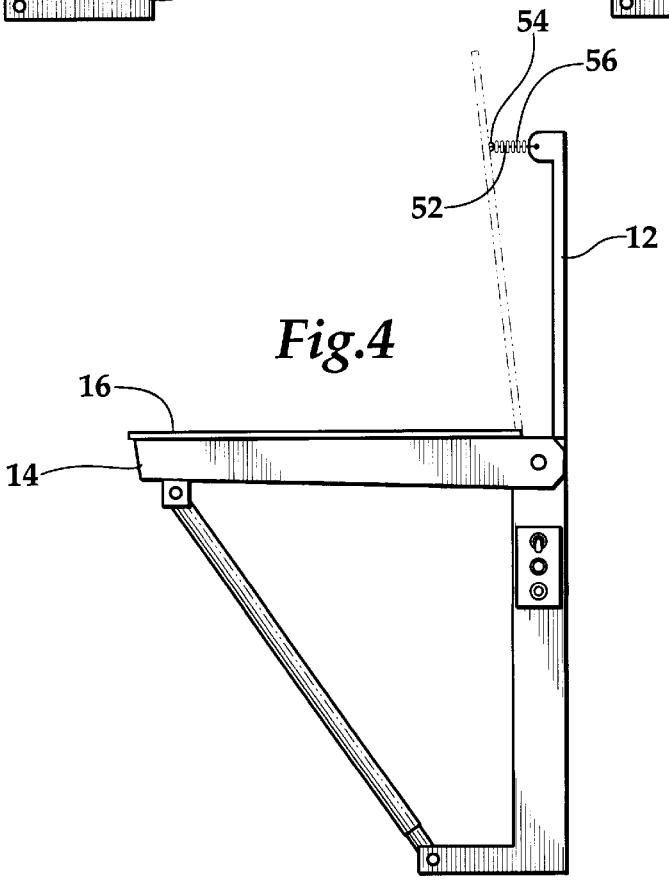
FIG. 4 is a side view of the invention, depicting the configuration of the invention after the fusible link has triggered, releasing the lid to cover the sink.
Figure 5:
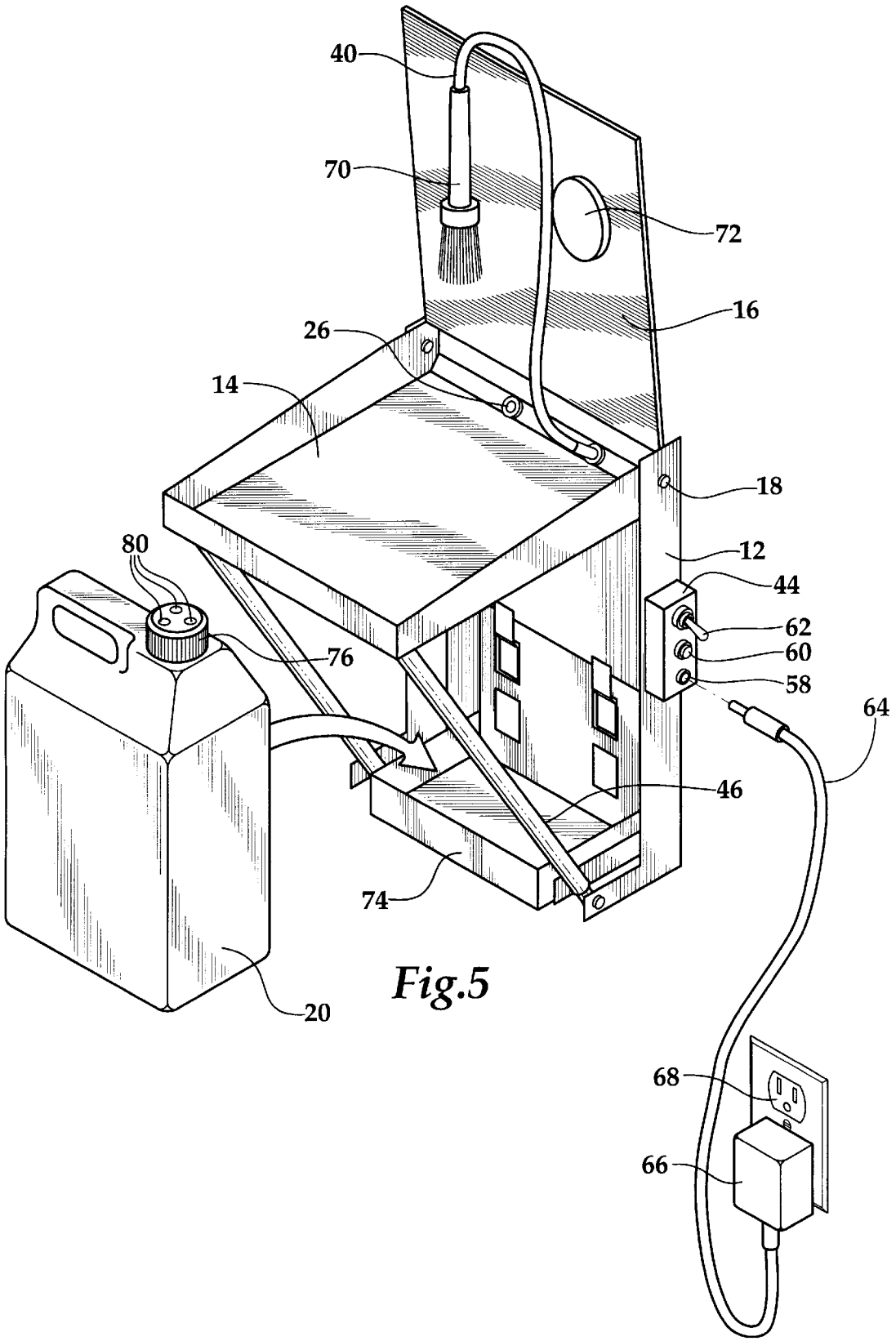
FIG. 5 is a front perspective view of several parts of the invention, demonstrating the use of a shelf fitted to the base to ensure proper and secure positioning of the separate cleaning fluid reservoir.

Referring now to FIGS. 3 and 4, the recirculating parts washer 10 preferably comprises a fusible link 52 suspending the lid 16 in an open position at an ordinary operating temperature (as depicted in FIG. 3) but releasing the lid 16 to cover the sink 14 at a higher temperature determined by the melting point of the fuse material (as depicted in FIG. 4). Most preferably, the fusible link 52 comprises a fuse 54 and a chain 56, so that, if a volatile cleaning fluid 22 in the sink 14 should unexpectedly ignite, the ambient heat would raise the fuse 54 to its melting temperature, allowing the chain 56 to drop lid 16 forward, so as to quickly cover the sink 14 and smother the fire.

Those of ordinary skill in the art will recognize that the fusible link 52 may be designed to activate at whatever temperature is appropriate under the circumstances surrounding use of the invention. In the interest of safety, the inventors and their assignee frequently set their fusible links 52 to engage at a temperature of about one hundred fifty eight (158) degrees Fahrenheit (about seventy (70) degrees Centigrade).

Returning now to FIG. 1, the recirculating parts washer 10 preferably employs a power supply assembly 44 comprising a jack 58 suitable for receiving a DC (i.e., direct current) power cable 64 from either an AC-to-DC (i.e., alternating current to direct current) converter 66 (as shown in FIG. 1) or a battery (not shown), a resetable thermal fuse 60, and an on-off switch 62. Such a power supply assembly 44 allows the recirculating parts washer 10 to be used both in a conventional shop environment (where a conventional alternating current (AC) power supply is likely close at hand) or at a remote location where a vehicular battery can provide a useful local source of direct current (DC) power. In the event of a pump motor burnout, the resetable thermal fuse 60 prevents burnout of the power supply.

It will be appreciated by those of ordinary skill in the art that according to a preferred embodiment of the recirculating parts washer 10, the surfaces of the sink 14 are angled in such a way that the force of gravity urges the cleaning fluid 22 to the drain line inlet end 26 (see, e.g., FIG. 1). According to a particularly preferred embodiment, lid 16 is equipped with magnets 72, as depicted in FIG. 1, to secure small, newly cleaned parts to the lid 16 (allowing them to air dry more quickly and allowing the user a greater amount of room in the sink 14 to clean the remaining parts).

Affixing an appropriately sized shelf 74 to the base 12 (see FIG. 5) ensures proper positioning of the separate cleaning fluid reservoir 20 and helps to prevent accidental disruption of the container. Similarly, a separate cleaning fluid reservoir cap 76, fitted with appropriately sized holes 80 to accommodate the power cable 42, drain line 24, and supply line 36, also helps to prevent accidental spillage and unnecessary evaporation of the cleaning fluid 22 (see FIGS. 1 and 5).

While several embodiments of the invention have been shown and described, other variations (which are in reality equivalents) will be readily apparent to those of ordinary skill in the art. Thus, the invention is not limited to the embodiments shown and described herein but, rather, is intended to cover all such variations as may be within the scope of the following claims.

We claim:

1. A recirculating parts washer comprising;

a substantially vertical base attached to a wall;

a sink rotatably connected to the base and selectively pivotable between at least a first use position substantially perpendicular to the base and a second storage position more nearly parallel to the base;

a releasable locking device that will selectively maintain the sink in at least the first and second positions relative to the base;

a lid rotatably connected to the base, said lid being selectively rotatable to cover the sink while the sink is in the first position;

a replaceable container of cleaning fluid;

a recirculating pump having an inlet and an outlet;

means providing fluid communication between the container and the pump inlet;

a fluid supply line providing fluid communication between the pump outlet and the sink; and a fluid drain line providing fluid communication between the sink and the replaceable container.

2. The recirculating parts washer of claim 1 wherein said sink comprises angled surfaces urging said cleaning fluid to said drain line.

3. The recirculating parts washer of claim 1 wherein a washing brush is attached to the supply line at the sink.

4. The recirculating parts washer of claim 1 wherein said base further comprises a fusible link maintaining said lid in an open position whenever the sink is disposed in the first position.

5. The recirculating parts washer of claim 1 wherein said lid further comprises a magnet to secure parts which have been cleaned to said lid.

6. The recirculating parts washer of claim 1, further comprising a jack suitable for receiving a power cable, a resettable thermal fuse, and an on-off switch.

7. The recirculating parts washer of claim 1 wherein the lid is rotatable into sealing engagement with the sink when the sink is in the first position.

8. The recirculating parts washer of claim 1 wherein the sink is rotatable into sealing engagement with the lid when the sink is in the second position.

9. The recirculating parts washer of claim 1 wherein the releasable locking device comprises at least one adjustable support arm.

10. The recirculating parts washer of claim 9 wherein the adjustable support arm is a telescoping arm having a spring-activated catch.

11. The recirculating parts washer of claim 1 wherein the recirculating pump is a submersible pump insertable into the replaceable container.

12. The recirculating parts washer of claim 11 wherein the pump is powered by direct current.

13. The recirculating parts washer of claim 12, further comprising a power supply including a battery.

14. The recirculating parts washer of claim 12, further comprising a power supply including an alternator.

15. The recirculating parts washer of claim 12, further comprising power supply including an AC-to-DC converter powered by a standard AC receptacle.

16. The recirculating parts washer of claim 1, further comprising a structure connected to the base and supporting the replaceable container of fluid below the sink.

17. A parts washer system comprising the recirculating parts washer of claim 1 in combination with a replaceable container of cleaning fluid having a cap with apertures permitting introduction of the fluid supply line and the fluid drain line into the container.

18. The parts washer system of claim 11 wherein the pump is a submersible pump insertable into the replaceable container.

19. The parts washer system of claim 18 wherein the replaceable container has a volume of about one gallon.

20. A recirculating parts washer comprising:

a substantially vertical base;

a sink rotatably connected to the base and pivotable between at least a first position substantially perpendicular to the base and a second position more narrowly parallel to the base;

a releasable locking device that will selectively maintain the sink in at least the first and second positions relative to the base;

a lid rotatably connected to the bases, and the base further comprising a fusible link maintaining said lid in an open position whenever the sink is disposed in the first position:

a cleaning fluid pump;

a fluid supply line having a first end connected to the pump to receive cleaning fluid from the pump and a second end disposed so as to selectively discharge pumped cleaning fluid into the sink; and a fluid drain line connected to the sink.

21. A recirculating parts washer comprising:

a substantially vertical base;

a sink rotatably connected to the base and pivotable between at least a first position substantially perpendicular to the base and a second position more nearly parallel to the base;

a releasable locking device that will selectively maintain the sink in at least the first and second positions relative to the base;

a lid rotatably connected to the base, the lid further comprising a magnet to secure parts which have been cleaned to said lid;

a cleaning fluid pump;

a fluid supply line having a first end connected to the pump to receive cleaning fluid from the pump and a second end disposed so as to selectively discharge pumped cleaning fluid into the sink;

and a fluid drain line connected to the sink.

22. A recirculating parts washer comprising:

a substantially vertical base;

a sink rotatably connected to the base and pivotable between at least a first position substantially perpendicular to the base and a second position more nearly parallel to the base;

a releasable locking device that will selectively maintain the sink in at least the first and second positions relative to the base;

a lid rotatably connected to the base;

a cleaning fluid pump;

a fluid supply line having a first end connected to the pump to receive cleaning fluid from the pump and a second end disposed so as to selectively discharge pumped cleaning fluid into the sink;

a fluid drain line connected to the sink;

a jack suitable for receiving a power cable;

a resettable thermal fuse; and an on/off switch.

23. A recirculating parts washer comprising:

a substantially vertical base;

a sink rotatably connected to the base and pivotable between at least a first position substantially perpendicular to the base and a second position more nearly parallel to the base;

a releasable locking device that will selectively maintain the sink in at least the first and second positions relative to the base;

a lid rotatably connected to the base, the sink being rotatable into sealing engagement with the lid when the sink is in the second position;

a cleaning fluid pump;

a fluid supply line having a first end connected to the pump to receive cleaning fluid from the pump and a second end disposed so as to selectively discharge pumped cleaning fluid into the sink; and a fluid drain line connected to the sink.

24. A parts washer system comprising a substantially vertical base;

a sink rotatably connected to the base and pivotable between at least a first position substantially perpendicular to the base and a second position more nearly parallel to the base;

a releasable locking device that will selectively maintain the sink in at least the first and second positions relative to the base;

a lid rotatably connected to the base;

a cleaning fluid pump;

a fluid supply line having a first end connected to the pump to receive cleaning fluid from the pump and a second end disposed so as to selectively discharge pumped cleaning fluid into the sink;

a fluid drain line connected to the sink; and a replaceable container of cleaning fluid having a cap with apertures permitting introduction of the fluid supply line and the fluid drain line into the container.

25. The parts washer system of claim 24 wherein the pump is a submersible pump insertable into the replaceable container.

26. The parts washer system of claim 24 wherein the replaceable container has a volume of about one gallon.

* * * * *